US009764798B1

(12) United States Patent
Voelker et al.

(10) Patent No.: US 9,764,798 B1
(45) Date of Patent: Sep. 19, 2017

(54) FOLDABLE ANCHOR

(71) Applicants: Scott Voelker, Miami, FL (US); Jonathan Batchelor, Jr., Miami, FL (US)

(72) Inventors: Scott Voelker, Miami, FL (US); Jonathan Batchelor, Jr., Miami, FL (US)

( * ) Notice: Subject to any disclaimer, the term of this patent is extended or adjusted under 35 U.S.C. 154(b) by 0 days.

(21) Appl. No.: 15/394,820

(22) Filed: Dec. 30, 2016

(51) Int. Cl.

| | |
|---|---|
| ***B63B 21/40*** | (2006.01) |
| ***B63B 21/24*** | (2006.01) |
| *B63B 21/36* | (2006.01) |
| *B63B 21/42* | (2006.01) |
| *B63B 21/32* | (2006.01) |
| *B63B 21/26* | (2006.01) |

(52) U.S. Cl.
CPC ..... *B63B 21/243* (2013.01); *B63B 21/32* (2013.01); *B63B 21/36* (2013.01); *B63B 21/42* (2013.01); *B63B 2021/262* (2013.01)

(58) Field of Classification Search
CPC ..... B63B 21/24; B63B 21/26; B63B 21/30; B63B 21/32; B63B 21/34; B63B 21/36; B63B 21/38; B63B 21/40; B63B 21/42; B63B 21/44; E02D 5/80; E02D 5/803
See application file for complete search history.

(56) References Cited

U.S. PATENT DOCUMENTS 2,202,856 A * 6/1940 Hottel ..... B63B 21/243 114/305
2,468,077 A 4/1949 Kellum
4,781,142 A * 11/1988 Cheung ..... B63B 21/44 114/301
5,353,732 A * 10/1994 Gramet ..... B63B 21/32 114/304
6,038,996 A * 3/2000 Giles ..... B63B 21/24 114/297
6,082,284 A * 7/2000 McCabe ..... B63B 21/26 114/301
6,155,194 A * 12/2000 Hoareau ..... B63B 21/42 114/304
6,564,515 B1 * 5/2003 Fontenot ..... E02D 5/80 114/294
8,561,565 B2 * 10/2013 Zimmerman ..... B63B 21/32 114/301
2016/0347420 A1 * 12/2016 Fitch ..... B63B 21/40

* cited by examiner

*Primary Examiner* — Andrew Polay
(74) *Attorney, Agent, or Firm* — Stevenson IP, LLC

(57) ABSTRACT

A foldable anchor storable on watercraft with limited storage and deck space and which secures watercraft in place in sandy and soft bottom boating areas and is releasable from underwater objects. The foldable anchor includes a forward anchor body with an internal weighted ballast on an anchor body and a two-part shank pivotably attached to a top end of the anchor body which allows the shank to pivot from an elevated position to a lowered position relative the anchor body. The shank has a rear portion and a front portion pivotably disposed thereon and foldable against the rear portion. Stabilizer wings between the front and rear portions assist the anchor body to roll into a correct upright position. Locking pins secure each of the rear and front portions together and the rear portion and anchor body together at selected angles. D-rings and breakable zip ties secure the shank to an anchor rope.

6 Claims, 5 Drawing Sheets

FOLDABLE ANCHOR

BACKGROUND OF THE INVENTION

Various types of watercraft anchoring devices are known in the prior art. However, very few watercraft anchoring devices work well in sandy and soft bottoms for smaller watercraft, such as kayaks, canoes, rowboats, stand up paddle boards, jet skis, and dinghies. In addition, existing watercraft anchoring devices for smaller watercraft that hold well in sandy bottoms are too large, too bulky, and too heavy for practical use and storage on the smaller watercraft and many of these devices also damage the smaller watercraft while the watercraft is in motion and bouncing in the water. Motorized watercraft typically store anchors onboard in either a storage bin or out in the open on the deck, while the smaller motorized watercraft have limited or no storage space for an anchor. Non-motorized watercraft, such as a kayaks or a stand up paddle boards, typically lack any storage space. Backpacks commonly used by the operators of non-motorized watercraft are too small for storing an anchor and, as a result, an anchor and the accessory anchor rope has to be carried along with other gear. At present, anchors commonly sold with non-motorized watercraft fail to stay positioned, which leads to frustration due to the constant need to reposition the watercraft or alternately tie up to other more stable watercraft or other immovable objects or, even further, tie the anchor ropes around the operator's hands thereby limiting the operator's ability to freely move in the water. In addition, existing anchors often require the non-motorized watercraft operators to go under water to set the anchor, particularly in rough water or in an area with a strong current. What is needed, and what the present foldable anchor provides, is a compact anchor which securely holds watercraft in place in sandy and soft bottom boating areas and which is also releasable from underwater objects, such as coral or rock, without damaging the environment.

FIELD OF THE INVENTION

The present invention relates to watercraft anchoring devices, and more particularly, to a foldable anchor.

SUMMARY OF THE INVENTION

The general purpose of the present foldable anchor, described subsequently in greater detail, is to provide a foldable anchor which has many novel features that result in a foldable anchor which is not anticipated, rendered obvious, suggested, or even implied by prior art, either alone or in combination thereof.

To accomplish this, the present foldable anchor is a compact anchor which securely holds watercraft in place in sandy and soft bottom boating areas and which is also releasable from underwater objects, such as coral or rock, without damaging the environment. The anchor body and shank are designed specifically to hold in sand and soft bottoms. However, the foldable anchor can be used in other bottom environments, as well. The present foldable anchor includes a first hinge connector connecting the anchor body to the shank so that the shank can pivot relative the anchor body to reduce the overall size of the anchor. In addition, the present foldable anchor includes a two-part shank having a second hinge connector which allows the shank to fold in half to further reduce the overall size of the anchor. The anchor rope can be attached to primary and secondary locations on the shank, depending on the nature of the bottom where anchor body is to hold. This structure allows the user to release the anchor body in the event the anchor body is caught on coral or another underwater object on the bottom. For coral reef areas, the shank structure helps to minimize damage to precious coral and also minimizes the need to cut the anchor line and leave the anchor body on the bottom when the anchor body catches on coral or another underwater object. Some regulations may require the ability to retrieve stuck anchors without damaging corals or sensitive bottom areas.

The foldable anchor allows the anchor body to land in a correct upright position in the sand every time because the shank has a pair of stabilizer wings, which extend perpendicularly from the shank in a position proximal the second hinged connector, to assist the anchor body to roll over into the correct upright position when the anchor lands on its side, such as on one of the left end or the right end thereof, via the combination of the stabilizer wings and a strategically-placed ballast within a leading edge of the anchor body which allows the anchor body to naturally land on the bottom end of the anchor body. A locking pin proximal each of the first hinge connector and the second hinge connector is provided to secure the respective first and second hinge connector into place to lock the rear portion of the shank into a selected position relative the anchor body top end and the front portion of the shank into a selected position relative the second portion of the shank.

The present foldable anchor is formed of plastic and/or rustproof metal materials which will not damage the watercraft, such as the storage compartments, while in motion and bouncing in the water. When the foldable anchor is manufactured in metal, the metal is coated in plastic or rubberized materials to cushion the metal in order to prevent damage to the watercraft. The present foldable anchor is provided in a wide range of sizes to anchor a wide range of watercraft. Thus has been broadly outlined the more important features of the present foldable anchor so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
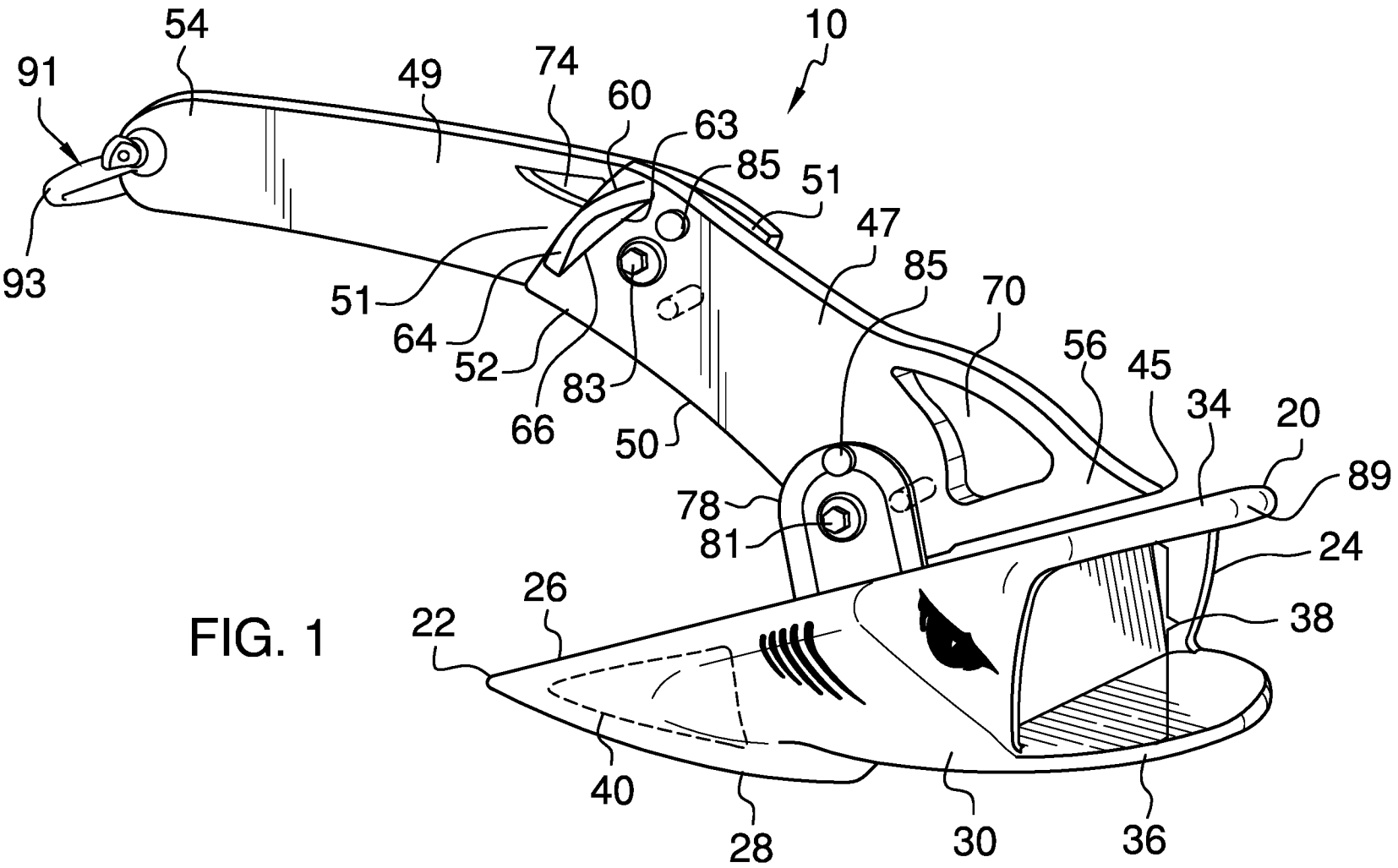
FIG. 1 is an isometric view showing a two-part shank in an extended position.
Figure 2:
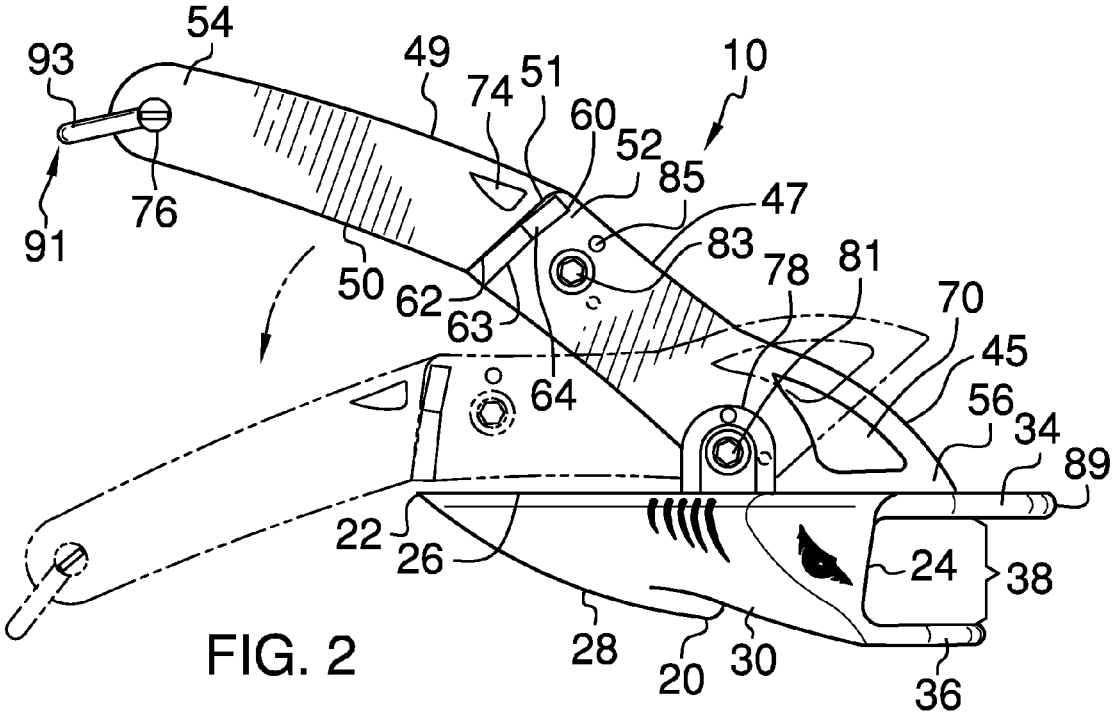
FIG. 2 is a side elevation view illustrating the pivotability of the shank relative an anchor body.
Figure 3:
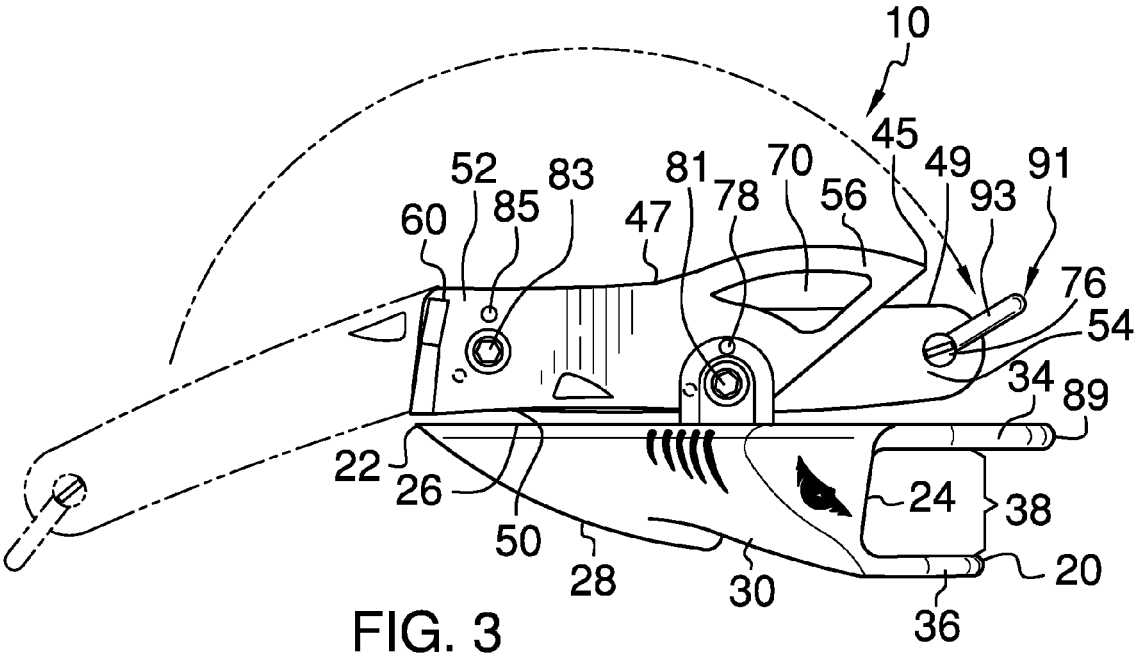
FIG. 3 is a side elevation view illustrating the foldability of the shank.
Figure 4:
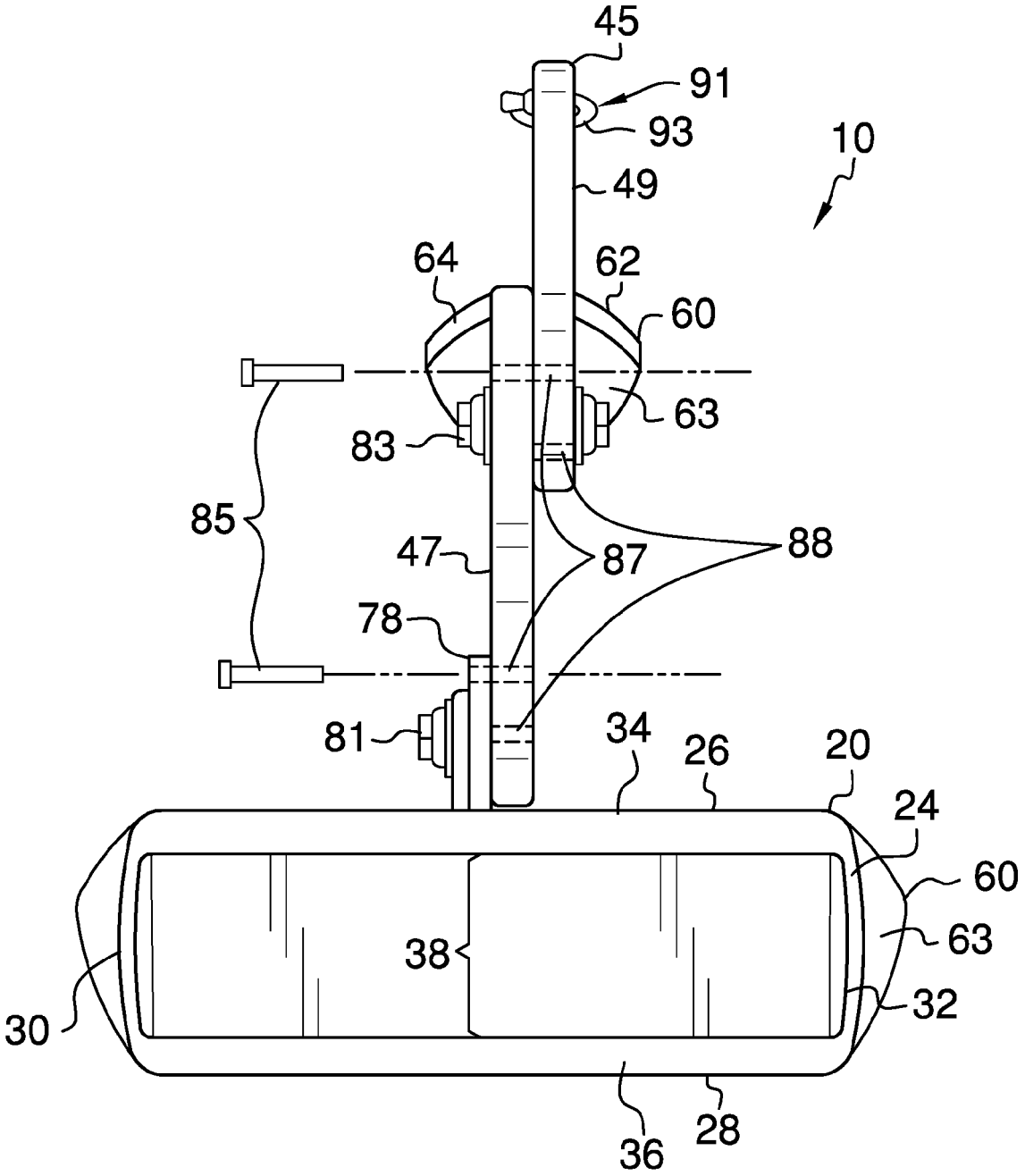
FIG. 4 is a rear elevation view.
Figure 5:
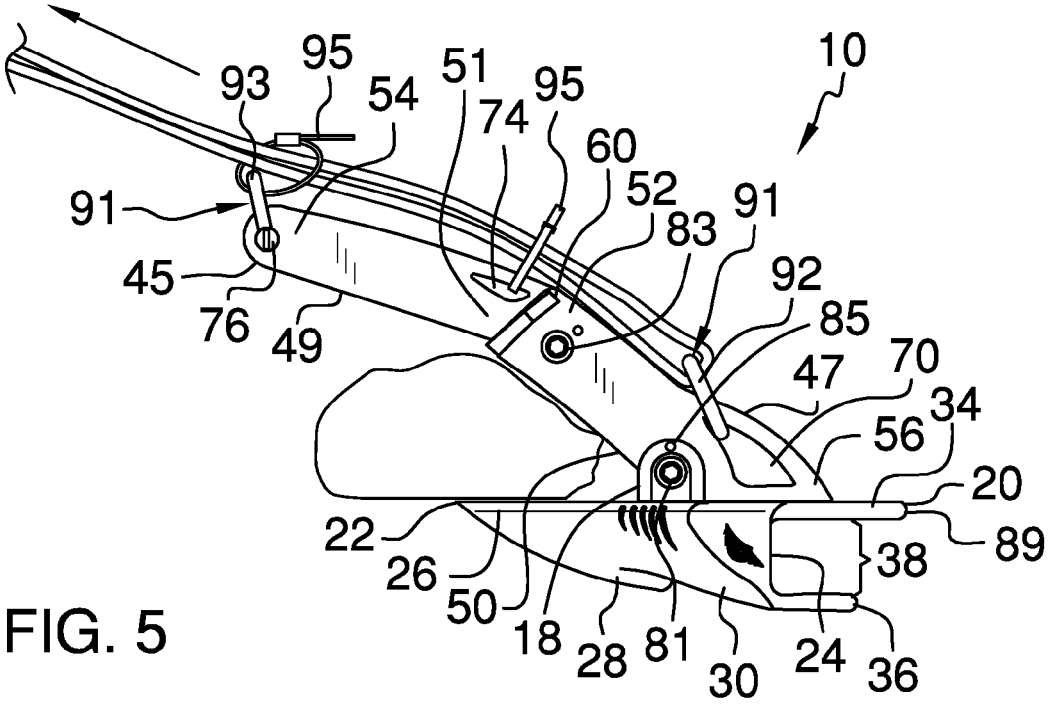
FIG. 5 is a side elevation view showing a rearward D-ring engaging an opening disposed through a back end of a rear portion of the shank and an end loop of an anchor rope and a forward D-ring engaging a hole disposed through a distal end of a front portion of the shank, and also showing a zip tie engaging each of the forward D-ring and the anchor rope and the aperture and the anchor rope, and further showing a top end of the anchor body being relatively perpendicular to the end loop and an underwater object lodged between the anchor body and the shank.
Figure 6:
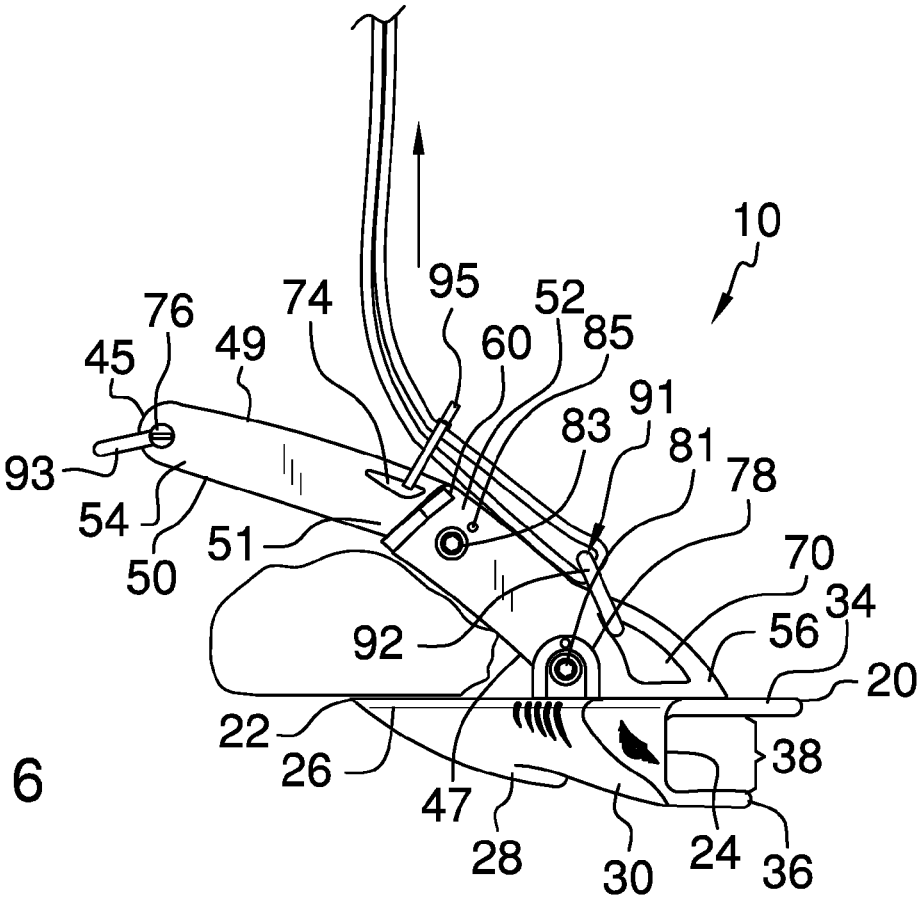
FIG. 6 is a side elevation view showing the disengagement of the forward D-ring and associated zip tie with the anchor rope, the engagement of the rearward D-ring with the end loop, the engagement of the zip tie with the aperture and the anchor rope and also showing the top end of the anchor body being relatively perpendicular to the end loop and the underwater object lodged between the anchor body and the shank.
Figure 7:
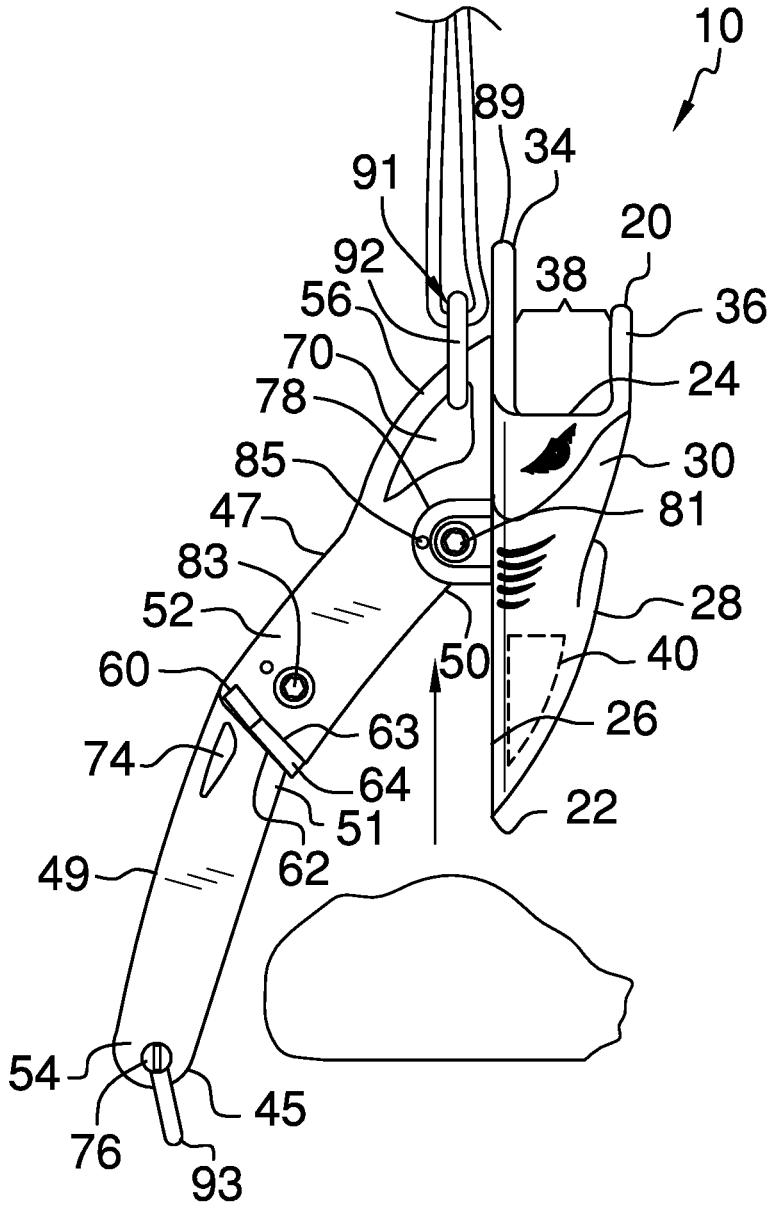
FIG. 7 is a side elevation view showing the disengagement of the forward D-ring and associated zip tie with the anchor rope, the disengagement of the zip tie with the aperture and the anchor rope and the continued engagement of the rearward D-ring with the end loop and further showing the top end of the anchor body being relatively parallel to the end loop and the leading edge of the anchor body being below the rear end and even further showing the dislodgement of the underwater object from a position between the anchor body and the shank.

With reference now to the drawings, and in particular FIGS. 1 through 7 thereof, an example of the instant foldable anchor employing the principles and concepts of the present foldable anchor and generally designated by the reference number 10 will be described.

Referring to FIGS. 1 through 7 the present foldable anchor 10 is illustrated. The foldable anchor 10 includes a substantially wedge-shaped anchor body 20. The anchor body 20 has a leading end 22, a rear end 24, a top end 26, a bottom end 28, a right end 30, and a left end 32. An upper extension 34 of the anchor body 20 extends from the rear end 24 in a position coplanar with the top end 26. A lower extension 36 of the anchor body 20 extends from the rear end 24 in a position coplanar with the bottom end 28. The upper extension 34 has a length greater than a length of the lower extension 36. The rear end 24 has a height and a width greater than a height and a width, respectively, of the leading end 22. An open cavity 38 is centrally disposed between the upper extension 34 and the lower extension 36. A weighted ballast 40 is disposed within the anchor body 20 at the leading end 22. The weighted ballast 40 allows the anchor body 20 to naturally land on the bottom end 28 of the anchor body 20.

A two-part shank 45 is pivotably attached to the top end 26 of the anchor body 20. The shank 45 has a substantially parallelepiped rear portion 47, a substantially paralllelpiped front portion 49, and an underside 50. The rear portion 47 is pivotably attached to the top end 26 of the anchor body 20. The front portion 49 has a proximal end 51 pivotably attached to a front end 52 of the rear portion 47. The front portion 49 also has a distal end 54 which is pivotable from an extended position extended away from the front end 52 of the rear portion 47 to a folded position. The rear portion 47 also has a back end 56. The distal end 54 of the front portion 49 is parallel to and directly adjacent the back end 56 of the rear portion 47 when the front portion 49 is in the folded position. In the folded position, the length of the device 10 is reduced for carrying and transporting the device 10 on watercraft having limited storage space and limited deck space.

A stabilizer wing 60 is disposed on each of the front end 52 of the rear portion 47 of the shank 45 in a position perpendicular to the rear portion 47 and the proximal end 51 of the front portion 49. Each stabilizer wing 60 has a flat triangle front wall 62, a flat triangle rear wall 63, an external wall 64, and an internal wall 66 disposed on the respective front end 52 and proximal end 51. The stabilizer wings 60 assist the anchor body 20 to roll over into a correct upright position when the anchor body 20 lands on one of the left end 32 or the right end 30 thereof.

An opening 70 is disposed through the back end 56 of the rear portion 47 of the shank 45. An aperture 74 is disposed through the proximal end 51 of the front portion 49. A hole 76 is disposed through the distal end 54 of the front portion 49.

The pivotability of the shank 45 relative the anchor body 20 is accomplished with the provision of an attachment body 78 disposed between a central point of the top end 26 of the anchor body 20 and the back end 56 of the rear portion 47 of the shank 45 proximal the opening 70 in a position between the opening 70 and the underside 50 of the shank 45. A first hinge connector 81 is disposed through the attachment body 78 and the back end 56 of the rear portion 47 of the shank 45. A second hinge connector 83 is disposed through the front end 52 of the shank 45 rear portion 47 and the proximal end 51 of the shank 45 front portion 49. The second hinge connector 83 permits the front portion 49 to pivot relative the rear portion 47 of the shank 45.

The shank 45 is pivotable with respect to the top end 26 of the anchor body 20 from an elevated position to a lowered position. The back end 56 of the shank 45 rear portion 47 is directly adjacent the top end 26 and the distal end 54 of the shank 45 front portion 49 is in a position at an angle approximately 225 degrees relative to the top end 26 when the shank is in the elevated position. The underside 50 of the shank 45 rear portion 47 is parallel and proximal to the top end 26 and the underside 50 of the shank 45 front portion 49 is at angle of approximately 135 degrees relative the top end 26 when the shank 45 is in the lowered position.

A pair of locking pins 85 engages a set of first guide channels 87 when the anchor is engaged and a set of second guide channels 88 when the rear end and the front end are in a folded position. One of the pair of locking pins 85 engages either the first guide channel 87, or the second guide channel 88 when the anchor is folded, through the respective attachment body 78 and shank 45 rear portion 47 proximal the first hinge connector 81 and the opening 70 to lock the rear portion 47 of the shank 45 into a selected position relative the anchor body 20 top end 26 while the other one of the pair of locking pins 85 engages either the first guide channel 87 or the second guided channel 88 and the shank 45 rear portion 47 and shank 45 front portion 49 proximal the second hinge connector 83 and the stabilizer wings 60. The locking pins 85 secure the respective first and second hinge connector 81, 83 into place and the front portion 49 of the shank 45 into a selected position relative the second portion 47 of the shank 45, respectively.

Each of the upper extension 34 and the lower extension 36 has a rounded outer end 89 to prevent the upper and lower extension 34, 36 from snagging onto an underwater object, such as coral, on the bottom of the body of water.

A pair of D-rings 91 is provided to secure the device 10 to an anchor rope. The pair of D-rings 91 includes a rearward D-ring 92 and a forward D-ring 93. The rearward D-ring 92 is engageable to each of the opening 70 and an end loop of an anchor rope. The forward D-ring 93 is engageable to the hole 76 disposed through the distal end 54 of the front portion 49. A pair of zip ties 95 is also provided. One of the pair of zip ties 95 is engageable to a respective one of the forward D-ring 93 and the anchor rope and the aperture 74 disposed through the proximal end 51 of the front portion 49 and the anchor rope. As used herein, the term "zip tie" is defined as a nylon or plastic fastener for holding items together and having a flexible tape section with a plurality of teeth that engage with a pawl in the head to form a ratchet so that as the free end of the tape section is pulled, the zip tie tightens and is secured. In use, if the anchor body 20 is caught on an underwater object, such as coral, on the bottom of the body of water, the user positions the watercraft to which the device 10 is attached directly atop the anchor body 20 and yanks and pulls the anchor rope vertically and upwardly toward the user until the pair of zip ties 95 break from the D-Ring 93 and from the aperture 74 on the shank 45. Once the anchor rope is free from the zip ties 95, the user continues to pull the anchor rope attached to D ring 92 and the anchor body 20 therewith vertically toward the user to release the anchor body 20 from the underwater object.

What is claimed is:

1. A foldable anchor comprising:

a substantially wedge-shaped anchor body having a leading end, a rear end, a top end, a bottom end, a right end, a left end, an upper extension extending from the rear end in a position coplanar with the top end, and a lower extension extending from the rear end in a position coplanar with the bottom end, the rear end having a height and a width greater than a height and a width, respectively, of the leading end;

an open cavity centrally disposed between the upper extension and the lower extension;

a weighted ballast disposed within the anchor body at the leading end;

a two-part shank pivotably attached to the top end of the anchor body, the shank having a substantially parallelepiped rear portion, a substantially paralllelpiped front portion, and an underside, the rear portion being pivotably attached to the top end of the anchor body, the front portion having a proximal end pivotably attached to a front end of the rear portion, the front portion further having a distal end being pivotable from an extended position extended away from the front end of the rear portion to a folded position, the rear portion further having a back end, wherein the distal end of the front portion is parallel to and directly adjacent the back end of the rear portion when the front portion is in the folded position;

a stabilizer wing disposed on each of the front end of the rear portion of the shank in a position perpendicular to the rear portion and the proximal end of the front portion, each stabilizer wing having a flat triangle front wall, a flat triangle rear wall, an external wall, and an internal wall disposed on the respective front end and proximal end;

an opening disposed through the back end of the rear portion of the shank;

an aperture disposed through the proximal end of the front portion; and a hole disposed through the distal end of the front portion;

wherein the shank is pivotable with respect to the top end of the anchor body from an elevated position to a lowered position, wherein the back end of the shank rear portion is directly adjacent the top end and the distal end of the shank front portion is in a position at an angle approximately 225 degrees relative to the top end when the shank is in the elevated position, wherein the underside of the shank rear portion is parallel and proximal to the top end and the underside of the shank front portion is at angle of approximately 135 degrees relative the top end when the shank is in the lowered position.

2. The foldable anchor of claim 1 comprising:

an attachment body disposed between a central point of the top end of the anchor body and the back end of the rear portion of the shank proximal the opening in a position between the opening and the underside of the shank;

a first hinge connector disposed through the attachment body and the back end of the rear portion of the shank; and a second hinge connector disposed through the front end of the shank rear portion and the proximal end of the shank front portion.

3. The foldable anchor of claim 1 comprising:

a pair of locking pins, one of the pair of locking pins disposed proximal one of the respective first hinge connector and the second hinge connector, each of the pair of locking pins engaging a first guide channel through the respective attachment body and shank rear portion proximal the opening and the shank rear portion and shank front portion proximal the pair of stabilizer wings; and the pair of locking pins, one of the pair of locking pins alternatively disposed proximal one of the respective first hinge connector and the second hinge connector, each of the pair of locking pins, alternatively engaging a second guide channel through the respective attachment body and shank rear portion proximal the opening and the shank rear portion and shank front portion proximal the pair of stabilizer wings.

4. The foldable anchor of claim 1 wherein the upper extension has a length greater than a length of the lower extension.

5. The foldable anchor of claim 1 comprising a rounded outer end on each of the upper extension and the lower extension.

6. The foldable anchor of claim 1 comprising:

a pair of D-rings, the pair of D-rings comprising a rearward D-ring engageable to each of the opening and an end loop of an anchor rope and a forward D-ring engageable to the hole disposed through the distal end of the front portion;

a pair of zip ties, one of the pair of zip ties engageable to a respective one of the forward D-ring and the anchor rope and the aperture disposed through the proximal end of the front portion and the anchor rope.

* * * * *